US005251885A

United States Patent [19]

Logan

[11] Patent Number: 5,251,885

[45] Date of Patent: * Oct. 12, 1993

[54] GOLF BALL DRIVE PRACTICE DEVICE

[76] Inventor: Neil Logan, 9094 W. Pioneer Rd., West Palm Beach, Fla. 33402

[ * ] Notice: The portion of the term of this patent subsequent to Apr. 28, 2009 has been disclaimed.

[21] Appl. No.: 839,569

[22] Filed: Feb. 20, 1992

Related U.S. Application Data

[63] Continuation of Ser. No. 589,996, Sep. 28, 1990, Pat. No. 5,108,102.

[51] Int. Cl.[5] ..... A63B 69/56

[52] U.S. Cl. ..... 273/182 R; 273/181 J; 273/181 F

[58] Field of Search ..... 273/176, 181, 182, 177

[56] References Cited

U.S. PATENT DOCUMENTS

| | | | |
|---|---|---|---|
| 1,166,496 | 1/1916 | Torrey . | |
| 1,894,814 | 1/1933 | Baker | 273/181 J |
| 1,923,152 | 10/1930 | Kohn . | |
| 1,960,113 | 12/1930 | Kohirogawa . | |
| 1,969,139 | 11/1930 | Knapp . | |
| 1,989,542 | 2/1933 | Boothman . | |
| 2,271,811 | 2/1942 | Cavanagh | 273/181 J |
| 2,582,290 | 4/1949 | Smith . | |
| 2,899,208 | 1/1957 | Wallsteiner . | |
| 3,310,313 | 12/1963 | Colson . | |
| 3,365,199 | 3/1965 | Scholin et al. . | |
| 3,411,788 | 11/1968 | Blanding . | |
| 3,420,528 | 1/1968 | Day . | |
| 3,492,003 | 6/1968 | Scholin . | |
| 3,561,765 | 4/1968 | Dixon et al. . | |
| 3,720,413 | 3/1973 | Ready . | |
| 3,758,118 | 11/1973 | Willcox . | |
| 4,215,865 | 8/1980 | Pilati . | |

FOREIGN PATENT DOCUMENTS 467944 6/1937 United Kingdom .

*Primary Examiner*—Mark S. Graham
*Attorney, Agent, or Firm*—Quarles & Brady

[57] ABSTRACT

A golf practicing device comprises a support base adapted to provide a mounting platform for a golf ball and a ball receptacle elevated above the support base positioned to catch the golf ball driven by a large golf club, such as a driver. The ball receptacle is movably attached to the support base through connecting means to move out of the swing radius of the golf club under the force of the driven ball received in the ball receptacle. The ball receptacle also provide a return track and outlet to permit a caught ball to exit onto a sloped return channel curved to guide the golf ball to a reservoir proximate the ball mounting position.

10 Claims, 6 Drawing Sheets

GOLF BALL DRIVE PRACTICE DEVICE

This is a continuation of application Ser. No. 589,996, filed Sep. 28, 1990, now U.S. Pat. No. 5,108,102.

BACKGROUND OF THE INVENTION

1. Field of the Invention

The present invention relates to a golf ball drive practice device and particularly to a golf practice device which returns balls to the user.

2. Prior Art

Golfers often engage in extensive practice of the various strokes used in actual golf play. The most common strokes practiced are putting, chipping and driving.

Putting strokes incorporate small stroke ranges resulting in short distances of ball travel. These factors as well as the relatively slow speed of the ball enable a golfer to practice putting in enclosed areas, such as an office, home or backyard In contrast, driving shots result in relatively long distance ball travel at high velocities. It was difficult, if not impossible, to practice drive shots indoors.

Several devices have been developed to practice putting, such as the apparatus shown by Smith, U.S. Pat. No. 2,582,290 and Colson, U.S. Pat. No. 3,310,313. These devices provide ball targets and automatic ball returns to enable the user to remain at a normal putting distance from the target.

None of these practice putting devices, however, are suited for catching and returning golf balls driven with large clubs, such as drivers and distance clubs. The structure of these known devices are not adapted to withstand and absorb the momentum of a high velocity golf ball. Additionally, the relatively small targets cannot accommodate the wide range of trajectories of a hard driven golf ball.

In putting, any balls which miss the target simply roll to a stop or collide with some surrounding object, imparting little or no damage. In contrast, a driven ball which misses the target imparts great force to objects in its path, causing potentially extensive damage.

A golf ball hit by a large club, such as a driver or distance club, can follow a wide range of trajectories. The trajectories can have a variety of elevation angles and bearings Because of the plurality of possible trajectories, drive shots have customarily been practiced in large fields, such as driving ranges, to avoid damage to surrounding objects. However, it is not always convenient or economical to use a driving range to practice golf driving shots.

SUMMARY OF THE INVENTION

It is therefore an object of the invention to provide a golf practicing device which enables a golfer to practicing driving shots in an enclosed area.

It is another object of the invention to provide a golf practicing device which is capable of catching golf balls which are driven with great force by a golf club, such as a driving wood or distance club.

It is yet another object of the invention to provide a golf practicing device which is adapted to catch golf balls driven through a wide range of trajectories.

It is still another object of the invention to provide a golf practicing device which automatically returns golf balls to the user.

These and other objects of the present invention are provided by a golf practicing device which comprises a support base which can provide a platform for mounting a golf ball. The platform can also be made sufficiently large so that a golfer can stand on the platform adjacent to the ball mounting position. A ball receptacle is movably attached to the support base and disposed to provide a ball inlet directed toward the golf ball mounting position.

The ball inlet of the receptacle can be positioned sufficiently close to the mounting position to receive balls shot in a wide range of trajectories. As the ball inlet is positioned closer to the mounting position, the range of ball trajectories that can be intercepted by the ball inlet increases.

In order to maximize the range of trajectories that can be intercepted, the receptacle can be brought within the swing radius of the golf club used to drive the golf ball To avoid contact between the golf club and the receptacle, the receptacle is movably mounted to the support base so as to either slide, pivot, or rotate away from the ball mount position and outside the club swing radius under the force of a golf ball driven into the receptacle.

The displacement of the receptacle also serves to dissipate the momentum of the golf ball. When the ball has been brought to a stop, the receptacle is urged back to its initial position by resilient means connected to the support base.

The receptacle can be constructed to additionally provide a return track along its bottom surface for guiding the golf ball to a receptacle outlet. The golf ball falls through the outlet to a return cup which extends into a curved channel. The ball can travel along the channel to a reservoir located near the user.

The receptacle can be a flexible sack or similar container which provides a ball inlet facing the ball mounting position. The receptacle is preferably supported by a front support structure which maintains the opening of the ball inlet. The support structure attaches to a moveable connecting means for elevating the receptacle above the support base. The connecting means preferably comprises a pair of elongated swing arms pivotally and slidingly connected to the support base and extending upwardly to connect to the front edge of the ball receptacle.

DETAILED DESCRIPTION OF THE PREFERRED EMBODIMENTS

Figure 1:
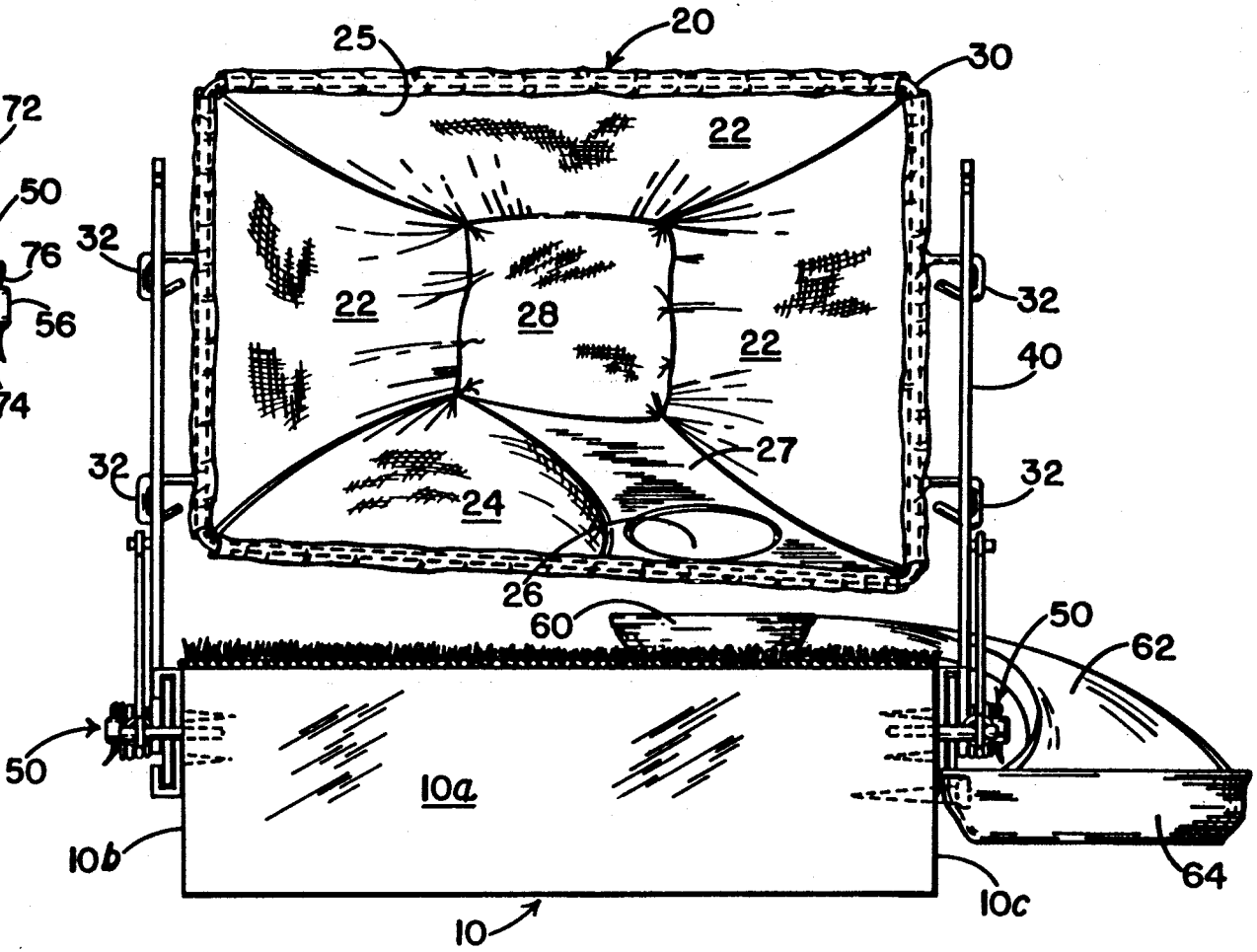
FIG. 1 is a front elevation view of a preferred embodiment of the invention.
Figure 2D:
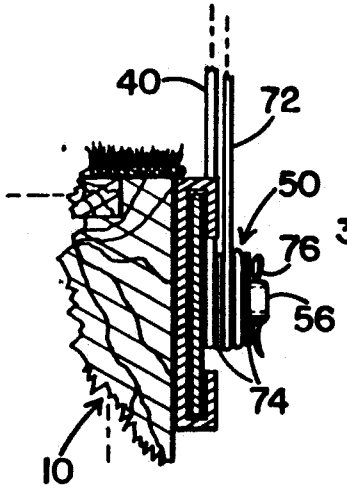
FIG. 2 is a right side elevation view thereof.
FIG. 2*a* is a detailed cutaway view along line A—A in FIG. 2, showing a pivot post assembly.
FIG. 2*b* is a perspective cutaway view of a receptacle connector inserted in a swing arm.
Figures 2, 2B:
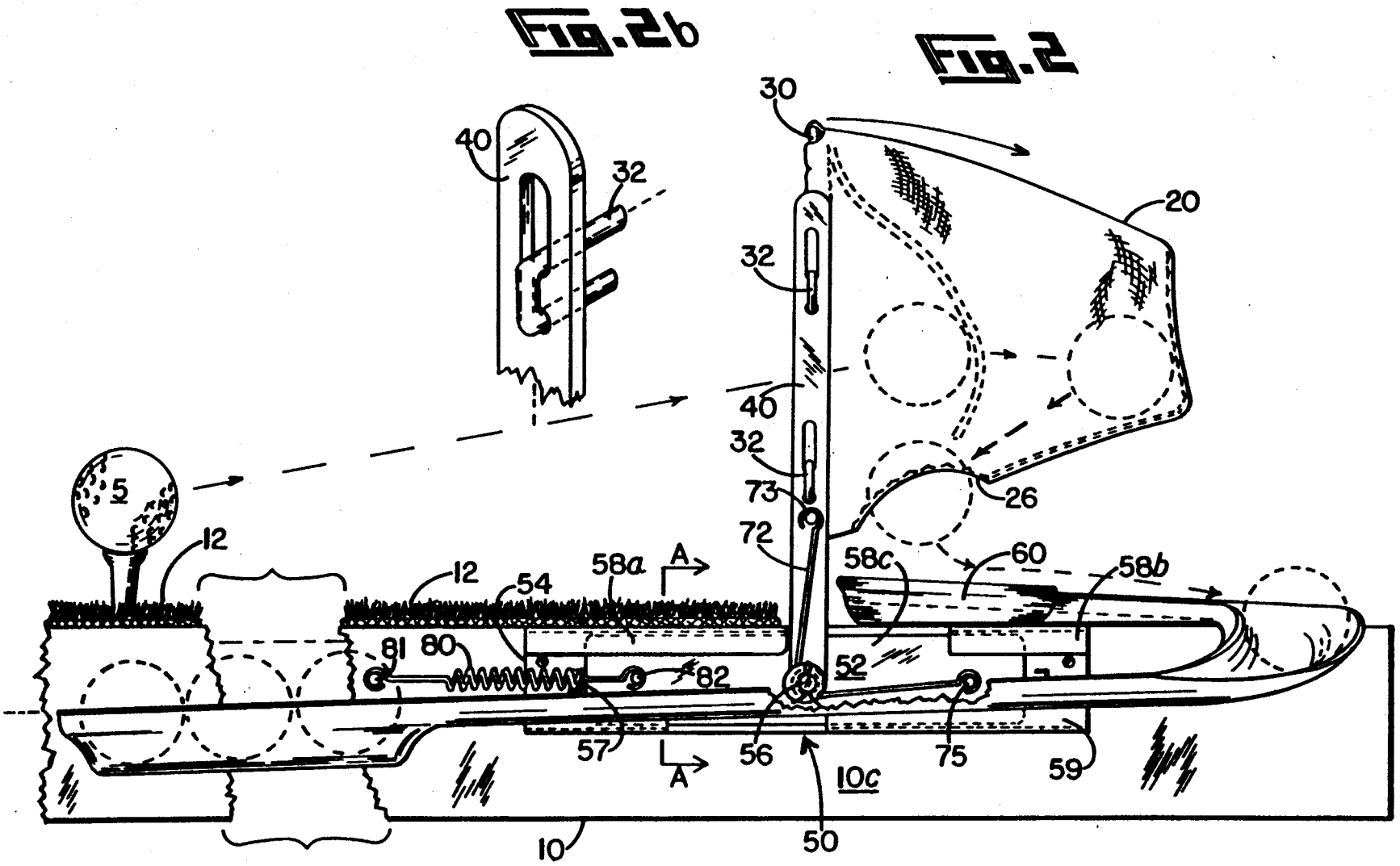
Figure 3:
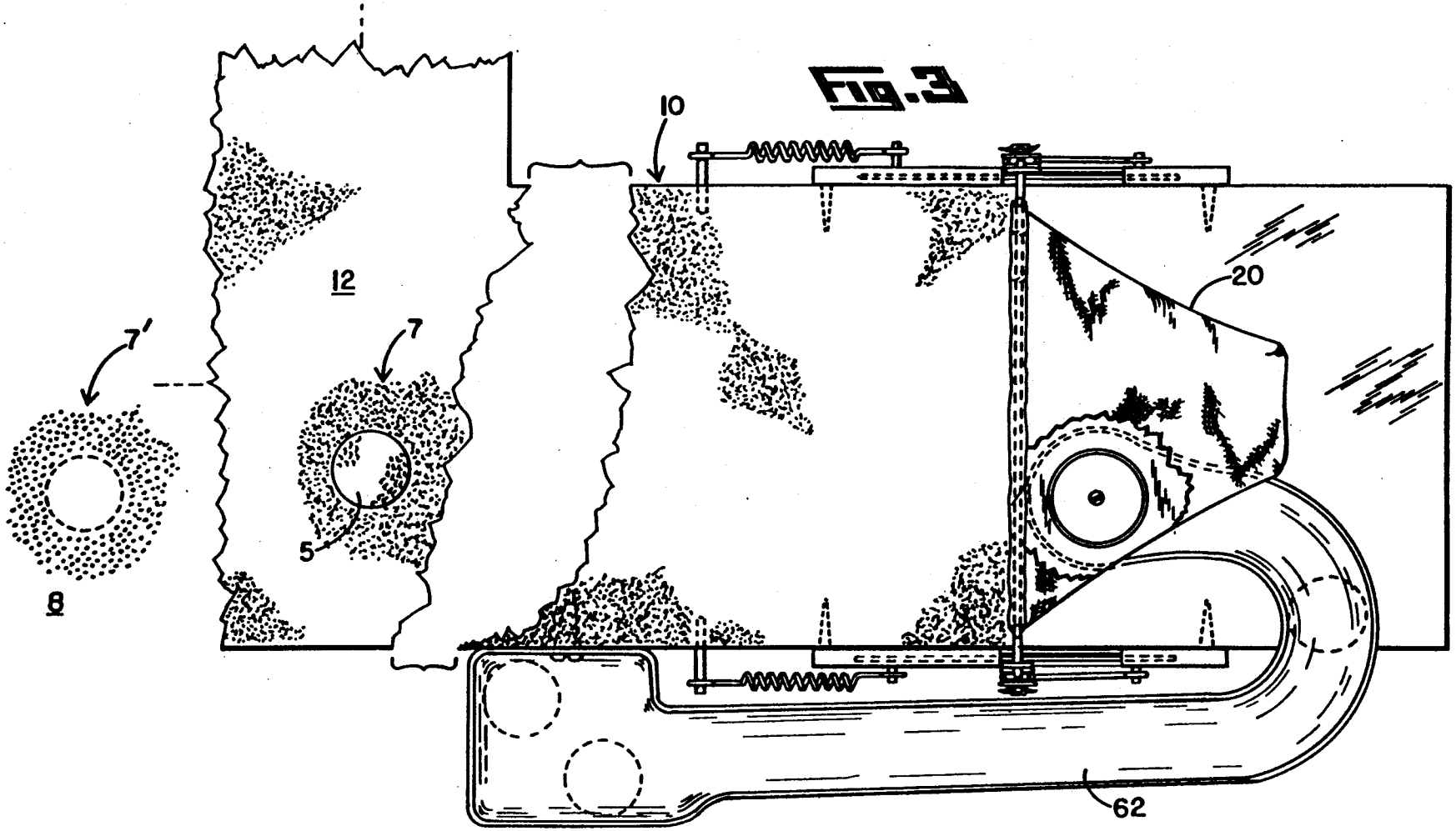
FIG. 3 is a top plan view of a preferred embodiment of the invention.

Referring now to the drawings and particularly to FIGS. 1–3, the present invention provides a golf practicing device which comprises a ball receptacle, such as flexible bag 20. Bag 20 is suspended above a support base 10 by connecting means, such as swing arms 40, to provide an elevated ball inlet 25 directed toward the front of support base 10*a*.

The ball inlet 25 is preferably held open by a bag support frame 30 around which the front peripheral edge of bag 20 is wrapped and secured. The bag support frame 30 provides a plurality of outwardly extending connectors, such as hooks 32, for attaching the bag support frame 30 to the swing arms 40. As shown in FIGS. 2 and 2*b*, the bag support frame 30 can alternatively be removably attached to the swing arms 40 by inserting hooks 32 into slots formed in swing arms 40, urging hooks 32 downwardly and inserting the lower hook ends into a holes formed below the swing arm slots.

The lower ends of the swing arms 40 are preferably pivotally connected to slide mechanisms 50, mounted to the left and right side walls 10*b* and 10*c* of support base 10.

The top and side surfaces 22 and bottom surface 24 of the bag 20 extend rearwardly from the ball inlet 25 and preferably taper toward a back surface 28 smaller than ball inlet 25. The bag surfaces are preferably made of flexible material, such a nylon, cloth or canvas, to absorb the impact of a ball driven into bag 20.

The bottom surface of bag 20 is reinforced by a return track 27 made of sturdy, somewhat flexible material, which is preferably plastic. Alternatively, the bottom surface 24 can be treated with a hardening agent to form a return track area which is less compliant than the top and side surfaces 22 of the bag 20. The return track 27 is sloped downwardly from the back surface 24 toward the ball inlet 25 to guide balls received in the bag 20 to an outlet 26 formed in the return track 27

A cup 60 is mounted to the support base 10 to receive balls exiting from the outlet 26 A return channel 62 extends from the cup 60 and preferably curves in a semicircle to extend forwardly to the front of support base 10 to form a ball reservoir 64 for collecting returned balls.

Referring to FIG. 2 which shows a detailed right side view of the preferred embodiment, the right swing arm 40 is pivotally connected at its lower end to a slide plate 52 of the slide mechanism 50. The slide plate 52 is slidingly disposed in a slide track 54 mounted to the support base 10. The swing arm 40 is pivotally mounted on a pivot post 56 extending from a medial portion of the slide plate 52.

In the preferred embodiment, a resilient means, such as arm return spring 72, is connected to the swing arm 40 and the slide plate 52. Arm return spring 72 attaches at one end to a spring pin 73 on swing arm 40, extends around pivot post 76 and connects at its opposite end to a spring pin 75 mounted to a rear portion of the slide plate 52. Referring to FIG. 2*a*, the arm return spring 72 can be configured as coils disposed around the pivot post 56 adjacent to the swing arm 40. Washers 74 permit rotation of the swing arm 40 relative to the arm return spring 72. The pivot post assembly thus described is preferably secured to the pivot post 56 by a cotter pin 76.

Referring again to FIG. 2, the slide track 54 preferably provides an upper channel 58 and lower channel 59. The upper channel 58 is separated into a forward portion 58*a* and rearward portion 58*b* by an opening 58*c*. This opening 58*c* permits the swing arm 40 to extend upwardly to the bag 20. The lower channel 59 can similarly provide an opening so that the slide track 54 can be used interchangeably for left or right side mounting to the support base 10.

The slide plate 52 is urged forwardly by resilient means, such as linear spring 80. The linear spring 80 can be attached at one end to the support base 10 by a spring pin 81 and at the opposite end to the slide plate 52 by a spring pin 82. To limit the forward displacement of the slide plate 52, a stop, such as tab 57, preferably extends outwardly from the slide track 54.

When a hard driven ball 5 impacts the bag 20, the ball force urges the bag 20 rearwardly. Under this force, the bag 20 and swing arm 40 are rotated rearwardly about pivot pin 56. Additionally, the slide plate 52 slides rearwardly to further displace the bag 20 relative to the support base 10.

After the ball 5 and bag 20 have come to a stop, the arm return spring 72 rotates the swing arm 40 forwardly. The forward rotation of the swing arm 40 is limited by the front portion 58*a* of upper track 58 so that swing arm 40 is positioned in its initial upright configuration. Additionally, the linear spring 80 pulls the slide plate 52 forward until the slide plate 52 engages the tab 57.

To maximize the displacement speed of the bag 20, it is preferable that the tensions of the arm return spring 72 and the linear spring 80 are minimized. Therefore, the arm return springs 72 and the linear springs 80 should preferably be selected to provide the minimum tensions necessary to return the swing arms 40 and slide plates 52 to their initial positions.

Referring to FIG. 1, after the swing arms 40 are returned to their initial upright configurations, the return track 27 in bag 20 is sloped downwardly toward the front of bag 20. The ball 5 disposed in bag 20 rolls down this return track 27 to exit through the outlet 26 onto the cup 60 of return channel 62. The ball travels in return channel 62 to the ball reservoir 64.

Referring to FIGS. 2–3, the support base 10 is preferably constructed to provide a platform 12 so that a golf ball 5 can be mounted, preferably on a tee, on the support base 10 proximate to the ball inlet 25 of the bag 20. As shown in FIG. 3, the dimensions of the support base 10 can be extended so that the user can stand on the platform 12 adjacent to the ball mounting position 7. Alternatively, a ball mounting platform 12 and associated base, separate from the support base 10 supporting receptacle 20, can be provided to allow variations in the separation distance between the ball receptacle 20 and the ball mounting position 7. Also, the ball 5 can be mounted on the surrounding ground 8 at a mounting position, such as ball mount 7'.

The distance of separation between the ball mounting position and the ball inlet 25 can be selected according to the desired range of ball trajectories which the user desires to intersect with the bag 20.

Referring to FIGS. 2–3, when bag 20 and swing arms 40 are rotated rearwardly under the force of driven ball 5, it is possible that the lower end of bag 20 can contact the upper surface of support base 10. The flexible bottom of bag 20 can be constructed to deform during engagement with support base 10. However, it is desirable to minimize the contact between bag 20 and support base 10 to reduce damage to bag 20 from frequent impact with support base 10. Accordingly, bag 20 can be pivotally attached to swing arms 40 so that the rear portion of bag 20 rotates upwardly relative to swing arms 40, thereby maintaining relatively parallel alignment with support base 10 after impact with driven ball 5.

Figure 4:
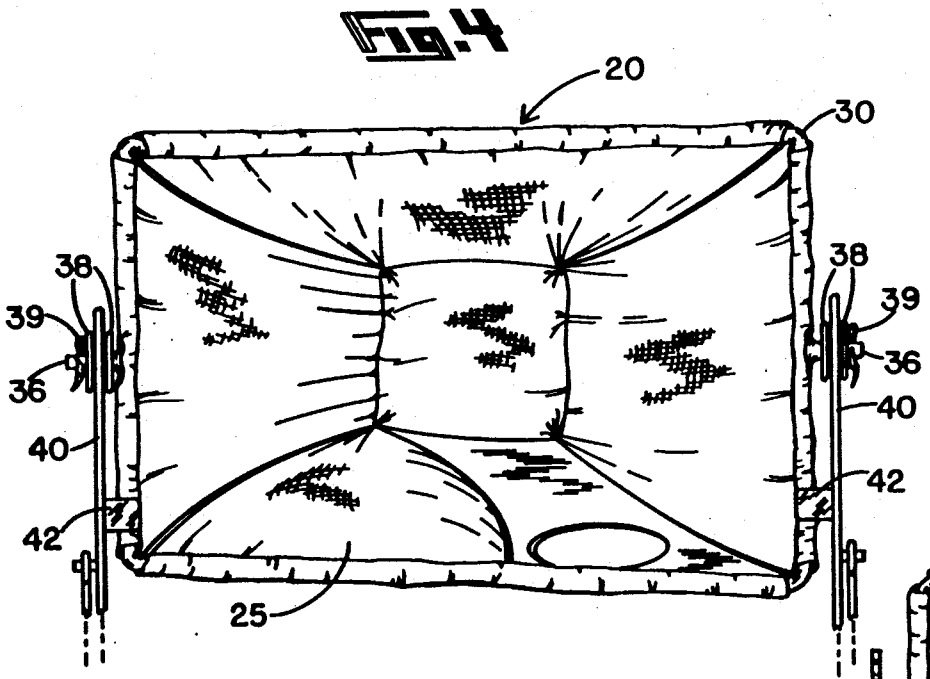
FIG. 4 is a front elevation view of an alternative embodiment of the ball receptacle, illustrating a pivot mounting of the ball receptacle to the swing arms.

Referring to FIG. 4, bag 20 and bag support frame 30 can be pivotally mounted to swing arms 40 by pivot posts 36 extending outwardly from bag support frame 30. Pivot posts 36 are inserted into apertures formed in the upper portions of swing arms 40 and are preferably secured by washers 38 and cotter pins 39.

When swing arms 40 are returned to their initial upright position as shown in FIGS. 1-3, the distribution of weight in bag 20 urges the rear portion of bag 20 to rotate downwardly relative to swing arms 40. Stop tabs 42 extend from swing arms 40 and engage bag support frame 30 to limit the rotation of bag 20 about pivot posts 36 so that ball inlet 25 is vertically positioned.

Figure 5:
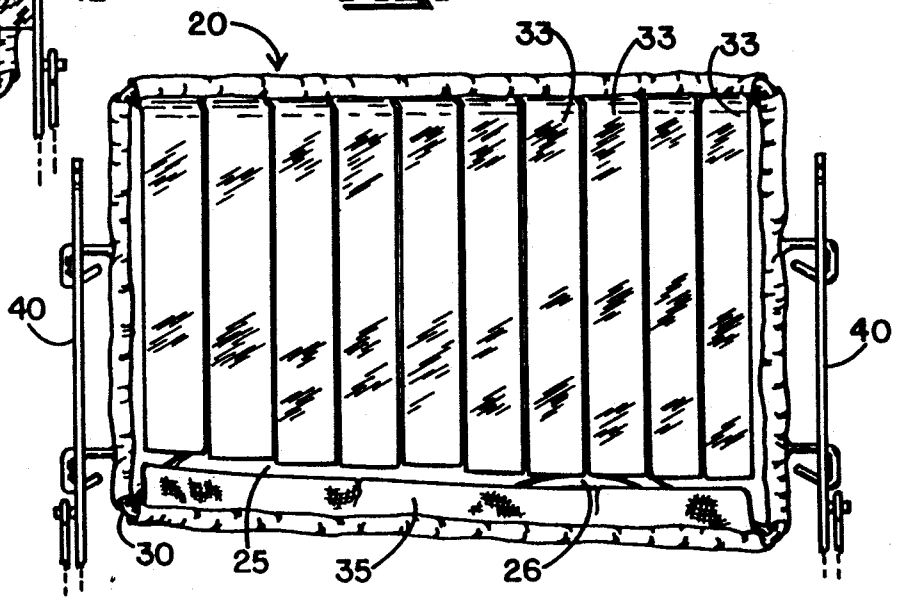
FIG. 5 is a front elevation view of an alternative embodiment of the ball receptacle with associated energy absorption strips and a ball stop strip.

Referring to FIG. 5, in an alternative embodiment of the receptacle 20, a plurality of energy absorption strips or baffles 33 can be hung or disposed in the ball inlet 25 of bag 20 to reduce the forward momentum of a ball received in bag 20 and inhibit the errant ejection of the received ball from the ball inlet 25 toward the user. Additionally, a flexible ball stop strip 35 can be provided along the lower edge of ball inlet 25 to prevent a ball guided along return track 27 from exiting bag 20 through ball inlet 25. Stop strip 35 further ensures that ball 5 is released from bag 20 through outlet 26.

Figure 6:
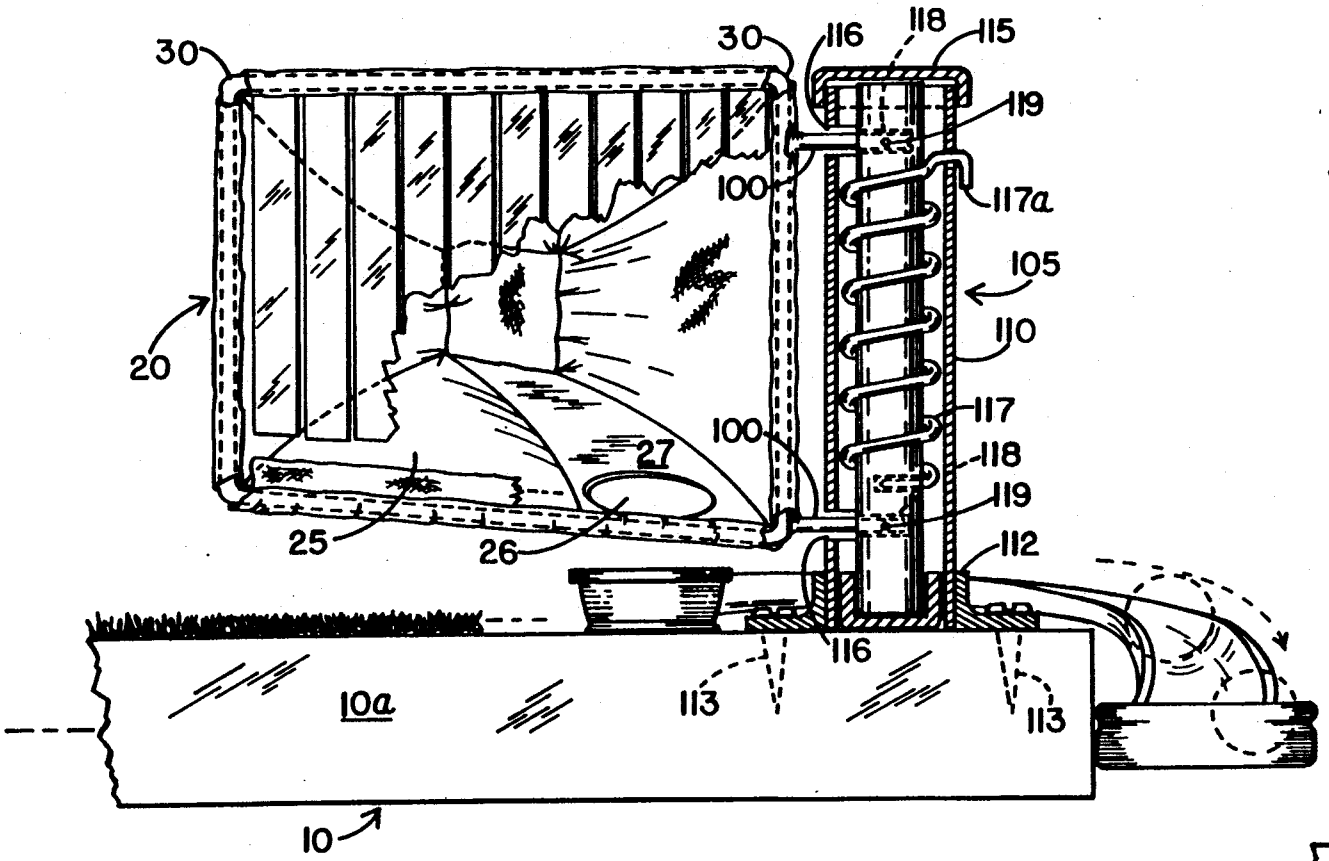
FIG. 6 is front elevation view of a second preferred embodiment of the invention with a sectional view of a vertical column assembly.

Referring now to FIG. 6, which shows a second preferred embodiment of the present invention, the bag 20 is suspended above the support base 10 by a vertical column assembly 105. The vertical column assembly 105 comprises a vertical column 120 disposed within a column housing 110. The vertical column 120 and the column housing 110 cooperate with a coil spring 117 to permit the bag 20 to rotate horizontally about a vertical axis and swing relative to the support base 10.

The bag support frame 30 provides a plurality of laterally extending support arms 100 which insert into apertures 118 provided in the vertical column 120. Column housing 110 similarly provides slots 116 for extension of support arms 100 between the vertical column 120 and bag support frame 30.

Coil spring 117 is disposed around vertical column 120 and secured at one end to vertical column 120 and secured at the opposite end to column housing 110. Coil spring 117 biases bag 20 in a ball receiving position in which the ball inlet 25 is directed towards or facing the golf ball mounting position (not shown) of the support base 10.

A cup support 114, disposed in column housing 110, provides pivotal base support to the vertical column 120. The vertical column 120 and coil spring 117 are secured within column housing 110 by a cap 115. A bracket 112 is connected to support base 10 by fasteners, such as screws 113. The column housing 110 can fastened to brackets 112 by welding or similar means.

Figure 7:
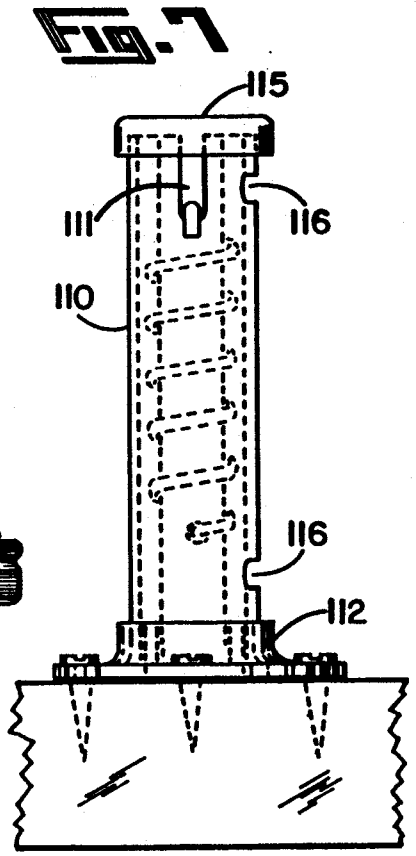
FIG. 7 is a right side elevation view of the vertical column assembly.

Referring to FIGS. 6 and 7, during assembly of the second preferred embodiment, the vertical column 120 and coil spring 117 are inserted into the column housing 110 through an aperture in the top of column housing 110. Column housing 110 provides a vertical groove 111 extending from the top of column housing 110 to permit insertion of spring end 117*a*.

Slot 118 in vertical column 120 are aligned with slots 116 in column housing 110 to permit insertion of support arms 100. To secure support arms 100 in slots 118, pin passage 119 is provided in the vertical column 120 and support arms 100. To insert a fastener, such as a pin, into pin passage 119, bag support frame 30 can be rotated rearwardly until pin passage 119 is aligned with slot 116. A fastener can then be inserted into pin passage 119.

Figure 8:
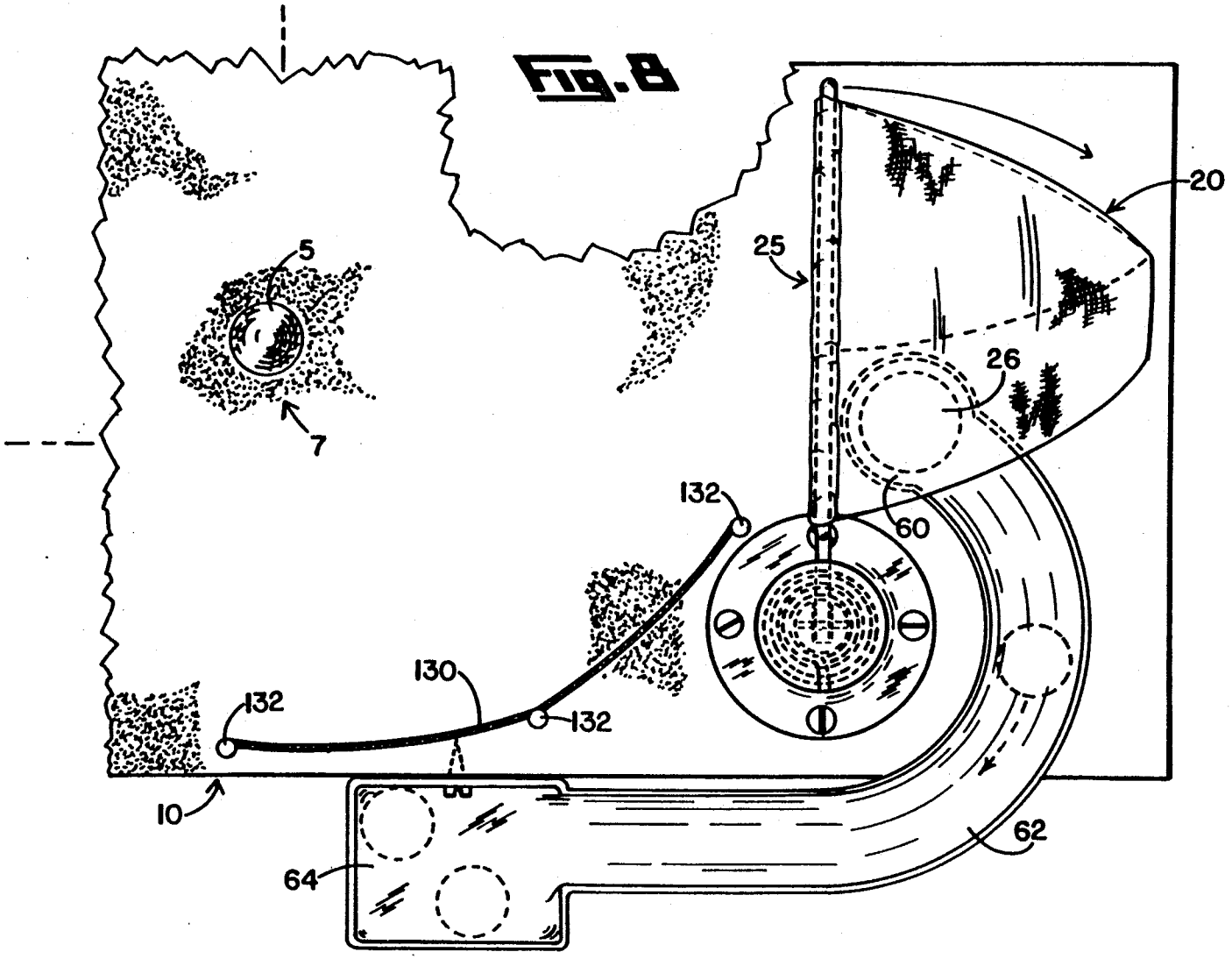
FIG. 8 is a top plan view of the second preferred embodiment.

Referring to FIG. 8, bag 20 is disposed above support base 10 with the ball inlet 25 directed towards or facing the golf ball mounting position 7 of support base 10. When ball 5 impacts bag 20, the resulting force urges bag 20 to move clockwise and swing rearwardly outside or beyond the swing radius of the club used to drive ball 5. The rotation of bag 20 causes the tension of spring 117 to increase, thereby dissipating the momentum of the ball imparted to the bag 20. Bag 20 provides an outlet 26 to permit ball 5 to exit onto cup 60 of return channel 62. It is possible that the ball 5 will be brought to a stop and exit the bag 20 before bag 20 returns to its initial position, as shown in FIG. 8. Therefore return channel 20 is curved to align with the path of outlet 26 during the rearward rotation of bag 20. This return channel 62 can be sloped downwardly from cup 60 to ball reservoir 64 so that ball 5 is urged under gravity to ball reservoir 64.

A deflection mesh 130 can be provided between the ball mounting position 7 and vertical column assembly 105 to prevent balls driven in trajectories to the right of ball inlet 25 from damaging vertical column assembly 105 or other surrounding objects. The deflection mesh 130 can be of any height but is preferably as tall as vertical column assembly 105. Vertical posts 132 may be provided to support deflection mesh 130.

The present invention thus provides a device for catching golf balls driven through a relatively wide range of airborne trajectories and returning the driven balls to the user. Although the invention has been described with a certain degree of particularity, it is understood that the present disclosure has been made only by way of example and that numerous changes in the details of the construction and the combination and arrangement of parts can be resorted to without departing from the scope of the invention. Thus, the scope of the invention should not be limited by the foregoing specification, but rather, only by a reasonable interpretation of the scope of the claims appended hereto.

I claim:

1. A golf practicing device for limiting the flight of driven golf balls, said device comprising:

a support base;

a ball receptacle having a ball inlet defined by a peripheral frame, said ball inlet facing in a front direction, said ball receptacle defined by a flexible bag-like structure extending rearwardly from said peripheral frame;

a mount for mounting a golf ball, said ball receptacle being elevated above said support base for receiving golf balls driven in trajectories which intersect said ball inlet;

means for elevating said ball receptacle above said support base, said elevating means being separate from and connected to the frame of said ball receptacle, said elevating means extending substantially vertically and laterally of said ball inlet relative to said front direction, said elevating means being pivotally connected to said support base for permitting said ball receptacle and said peripheral frame to pivot rearwardly relative to said support base under force of said golf ball received in said receptacle about a pivot axis located in a plane defined by said ball inlet when said ball receptacle is configured in an initial upright position.

2. The golf practicing device of claim 1, wherein said elevating means comprises a plurality of swing arms pivotally connected to said support base.

3. The golf practicing device of claim 2, wherein said swing arms are slidingly connected to said support base.

4. The golf practicing device of claim 3, wherein said swing arms are pivotally connected to said ball receptacle.

5. The golf practicing device of claim 1, wherein said elevating means includes a vertical column rotatably connected to said support base and connected to a lateral side of said ball receptacle whereby said ball receptacle can swing about a vertical axis of said vertical column from said initial position away from said mounting position relative to said support base.

6. The golf practicing device of claim 1 further comprising ball return means partially disposed on said support base for returning a golf ball received in said ball receptacle to a position proximate said mount.

7. The golf practicing device of claim 6, wherein the ball returns means comprises an outlet formed in said ball receptacle and a return channel connected to said support base and partially disposed below said outlet.

8. The golf practicing device of claim 1, wherein said ball receptacle further comprises a plurality of energy absorption strips depending from a top front edge of said ball receptacle to partially cover said ball inlet, said energy absorption strips being flexible to permit said golf ball to enter said ball receptacle and to inhibit said golf ball from exiting said ball receptacle through said ball inlet.

9. The golf practicing device of claim 1, wherein said ball mount is on the ground.

10. The golf practicing device of claim 1, wherein said ball mount is disposed on a platform which can be disposed at various distances from said support base to vary separation between said ball mount and said ball inlet.

* * * * *